US010363595B2

(12) United States Patent
Hewitt et al.

(10) Patent No.: US 10,363,595 B2
(45) Date of Patent: Jul. 30, 2019

(54) CEMENTED CARBIDE NECKING TOOL

(71) Applicant: HYPERION MATERIALS & TECHNOLOGIES (SWEDEN) AB, Stockholm (SE)

(72) Inventors: Stephen A. Hewitt, Coventry (GB); Elena Tarres Puit, Coventry (GB); Victor Rimbau, Barcelona (ES)

(73) Assignee: HYPERION MATERIALS & TECHNOLOGIES (SWEDEN) AB

( * ) Notice: Subject to any disclaimer, the term of this patent is extended or adjusted under 35 U.S.C. 154(b) by 522 days.

(21) Appl. No.: 14/299,029

(22) Filed: Jun. 9, 2014

(65) Prior Publication Data

US 2015/0352625 A1 Dec. 10, 2015

(51) Int. Cl.

| | |
|---|---|
| ***B21D 37/01*** | (2006.01) |
| ***B21D 51/26*** | (2006.01) |
| ***C22C 29/08*** | (2006.01) |
| ***C22C 29/02*** | (2006.01) |

(52) U.S. Cl.

CPC ..... *B21D 51/2638* (2013.01); *B21D 37/01* (2013.01); *C22C 29/02* (2013.01); *C22C 29/08* (2013.01); *Y10T 428/12014* (2015.01)

(58) Field of Classification Search

None

See application file for complete search history.

(56) References Cited

U.S. PATENT DOCUMENTS

| | | | | |
|---|---|---|---|---|
| 4,514,224 | A * | 4/1985 | Nishigaki | C22C 29/02 75/236 |
| 4,636,252 | A * | 1/1987 | Yoshimura | C22C 29/02 419/13 |
| 5,736,658 | A | 4/1998 | Mirchandani et al. | |
| 2006/0272448 | A1* | 12/2006 | Engstrom | B21C 3/02 75/240 |
| 2008/0292737 | A1* | 11/2008 | Banerjee | B29B 9/065 425/10 |
| 2009/0193866 | A1* | 8/2009 | Hamstra | B21D 19/08 72/105 |
| 2012/0312066 | A1 | 12/2012 | Myers et al. | |

FOREIGN PATENT DOCUMENTS

| | | | |
|---|---|---|---|
| CN | 103540824 | A | 1/2014 |
| EP | 2439294 | A1 | 4/2012 |
| EP | 2460598 | A1 | 6/2012 |
| EP | 2439294 | B1 | 3/2014 |
| SU | 1690917 | A1 | 11/1991 |
| WO | 01/14608 | A1 | 3/2001 |
| WO | 2005054530 | A | 10/2004 |
| WO | 2007/136608 | A2 | 11/2007 |
| WO | 2008079083 | A1 | 7/2008 |
| WO | 2008/147660 | A1 | 12/2008 |
| WO | 200814787 | A1 | 12/2008 |
| WO | 2009094763 | A1 | 8/2009 |

OTHER PUBLICATIONS https://en.wikipedia.org/wiki/Galling.

* cited by examiner

*Primary Examiner* — Adam Krupicka

(57) ABSTRACT

A necking tool for manufacturing of metal beverage cans, the necking tool being a cemented carbide comprising in wt % of about 18 to about 63 WC, of about 21 to about 30 TiC, of about 0 to about 27 TiN, of about 0 to about 12 NbC, of about 0 to 2 $Cr_3C_2$, of about 8 to about 14 Co and of about 0 to about 6 Ni.

16 Claims, 4 Drawing Sheets

CEMENTED CARBIDE NECKING TOOL

TECHNICAL FIELD AND INDUSTRIAL APPLICABILITY

The present disclosure relates to a cemented carbide necking tool having lower density, higher hardness, and closer thermal expansion to tool steel for applications in the can manufacturing industry.

SUMMARY

In one aspect there is provided a necking tool for manufacturing of metal beverage cans, the necking tool being a cemented carbide containing in wt % of about 18 to about 63 WC, of about 21 to about 30 TiC, of about 0 to about 27 TiN, of about 0 to about 12 NbC, of about 0 to about 2 $Cr_3C_2$, of about 8 to about 14 Co and of about 0 to about 6 Ni.

According to another aspect there is provided a necking tool for manufacturing of metal beverage cans, the necking tool being a cemented carbide including in wt % about less than 63 WC; about 21 TiC; about 2 $Cr_3C_2$; about 8 Co; and less than about 6 Ni.

In yet another aspect there is provided a necking tool for manufacturing of metal beverage cans, the necking tool being a cemented carbide including in wt % about 18 WC, less than about 30 TiC, less than about 27 TiN, less than about 12 NbC, and about 14 Co.

These and other objects, features, aspects, and advantages of the present disclosure will become more apparent from the following detailed description of the preferred embodiment relative to the accompanied drawings, in which:

DETAILED DESCRIPTION

Over 280 billion beverage cans are produced worldwide every year. During the process, the upper section of the can is reduced in a necking-in operation to accommodate a top. Dies are commonly used in the necking operation. Due to the large number of cans produced service life of the die tool is crucial.

Accordingly, the necking die material must satisfy the most demanding applications. Cemented carbide, which is produced using modern powder metallurgical processes, offers a unique combination of strength, hardness and toughness. Cemented carbide, as used herein, is defined as a hard, carbide phase, 70 to 97 wt-% of the composite and a binder phase. Cemented carbides include standard WCCo, Cermets and hybrids. Tungsten carbide (WC) is the most common hard phase and cobalt (Co) the most common binder phase. These two materials form the basic cemented carbide structure. From this basic concept many other types of cemented carbide have been developed. In addition to WC—Co compositions, varying proportions of titanium carbide (TiC), tantalum carbide (TaC) or niobium carbide (NbC) or others can be used. In addition, the cobalt binder phase can be alloyed with or completely replaced by nickel (Ni), chromium (Cr), iron (Fe), molybdenum (Mo) or alloys of these elements.

Figure 1:
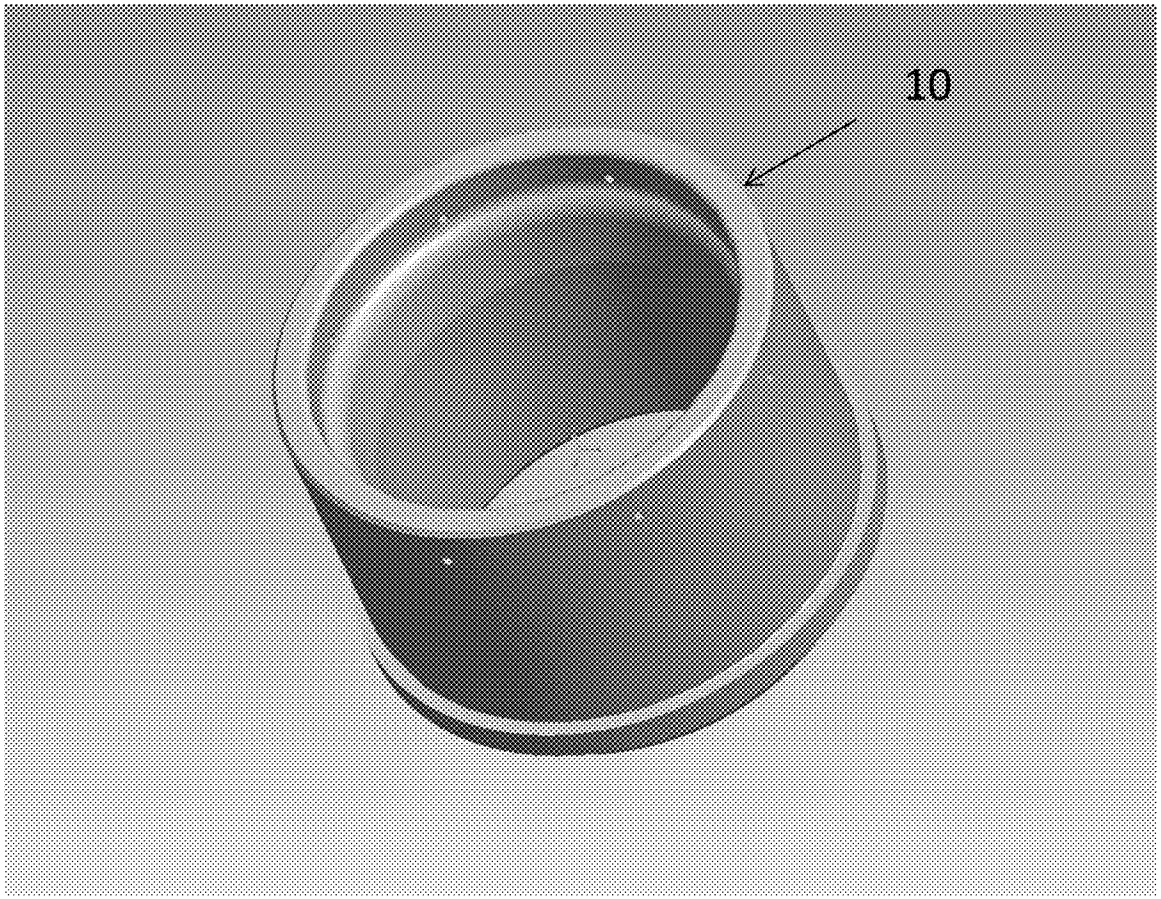
FIG. 1 is a perspective view of a known necking die used in manufacturing metal beverage cans.

By varying the composition, the resulting physical and chemical properties can be tailored to ensure maximum resistance to wear, deformation, fracture, corrosion, oxidation and other damaging effects. The available unique composition of cemented carbide makes it an ideal tool material for forming and stamping in the can making process. An example of a known die 10 is illustrated in FIG. 1. Typical necking dies work with knock out that is normally made of tool steel due to reduced cost. The match gap of the knock out and necking dies must be kept as constant as possible during start up and running conditions of the necker machine, therefore the closer the thermal expansion of the necking die to the tool steel the better.

EP2439294, assigned to the assignee of the present disclosure discloses a cemented carbide punch used for the manufacturing of metal beverage cans. The particular disclosed cemented carbide has a hard phase of WC and a binder phase based on Co and Ni. The composition comprises, in wt-%, from 50 to 70 WC, from 15 to 30 TiC (titanium carbide) and from 12 to 20 Co+Ni. The punch application is particularly suited to this particular composition as the weight of the punch can be lowered and production speeds increased.

WO2008079083, also assigned to the assignee of the present disclosure, discloses a cemented carbide punch used in cold forming and drawing operations, particularly in the manufacture of beverage cans. The cemented carbide is essentially, in wt %: 70-90 WC; 2-8 TiC, 1-9 NbC, 0-3 TaC and 5-20 binder phase of Co with an addition of Cr and possibly one or more of the elements selected from Ni, Fe and Mo. More particularly the binder composition is, also in wt %: 10-98 Co, 0-50 Ni, 2-15 Cr, 0-50 Fe and 0-10 Mo.

Further, grades with binder content in the range of 3 to 10 wt % and grain sizes below 1 μm have the highest hardness and compressive strength, combined with high wear resistance and high reliability against breakage. As used herein grade can be defined as tungsten carbide (WC) in combination with a binder phase of cobalt (Co) and/or nickel (Ni), and any other single or combination of carbide phases (TiC, Ta/NbC etc.). However, the binder phase of cemented carbides is susceptible to wet corrosion resulting in wear problems. Accordingly, sub-micron carbide grains combined with the appropriate binder have been used in WC—Co carbide punches.

However, such materials have not been previously used for necking dies.

The present disclosure relates to cemented carbide including hybrids and cermets for necking applications in the can manufacturing industry. The advantages associated with these new materials can be seen in higher hardness, lower density, and closer thermal expansion to a tool steel knock-out and enhanced toughness compared to existing ceramic material used for necking dies Cemented carbide grades with the compositions in wt % according to Table 1 below were produced according to known methods. The cemented carbide samples were prepared from powders forming the hard constituents and powders forming the binder, which were wet milled together, dried, pressed into bodies of desired shape and sintered.

TABLE 1

| GRADE | WC | TiC | TiN | NbC | $Cr_3C_2$ | Co | Ni |
|---|---|---|---|---|---|---|---|
| SAMPLE A | 63.00 | 21.00 | 0.00 | 0.00 | 2.00 | 8.00 | 6.00 |
| SAMPLE B | 18.00 | 30.00 | 27.00 | 12.00 | 0.00 | 14.00 | 0.00 |
| COMPARATIVE | 88.0 | 0.00 | 0.00 | 0.00 | 1 | 12 | 0.00 |

A known cemented carbide, Sandvik grade H12N, (Sandvik AB, Sandviken, SE), used in the can tooling industry, was used as the comparative sample. The comparative sample contains in wt % less than about 88 WC; about 12 Co; and about 1 $Cr_3C_2$, preferably 87.5% WC, 12% Co and 0.5 $Cr_3C_2$. Moreover, the comparative sample has a medium carbide grain size, a corrosion resistance on a subjective scale of 1 to 10 of about 3, a wear resistance on a subjective scale of 1 to 10 of about 5, a compressive strength of about 4600 MPa, and a fracture toughness, per the Palmqvist method, of about 16 MPa $m^{1/2}$.

Example

Figure 2:
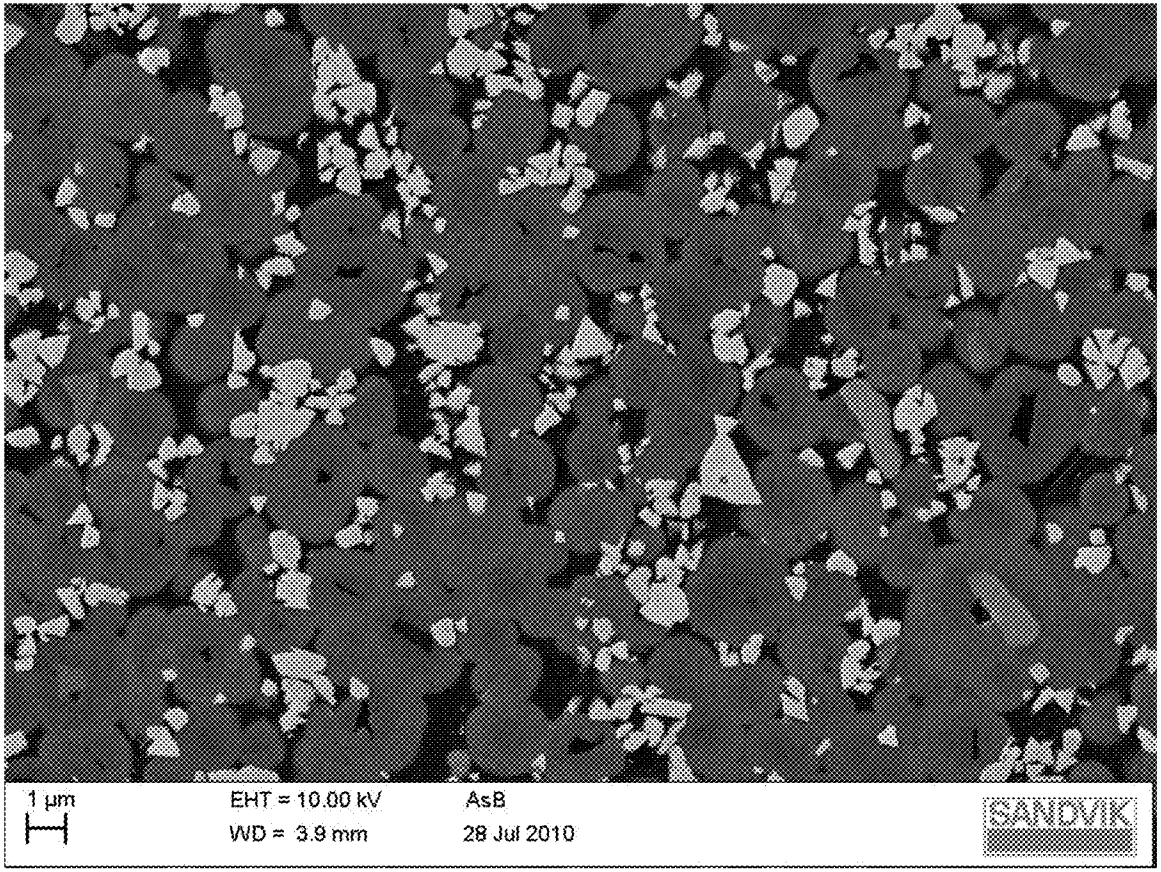
FIG. 2 is a SEM image of a first necking tool material according to the present disclosure.
Figure 3:
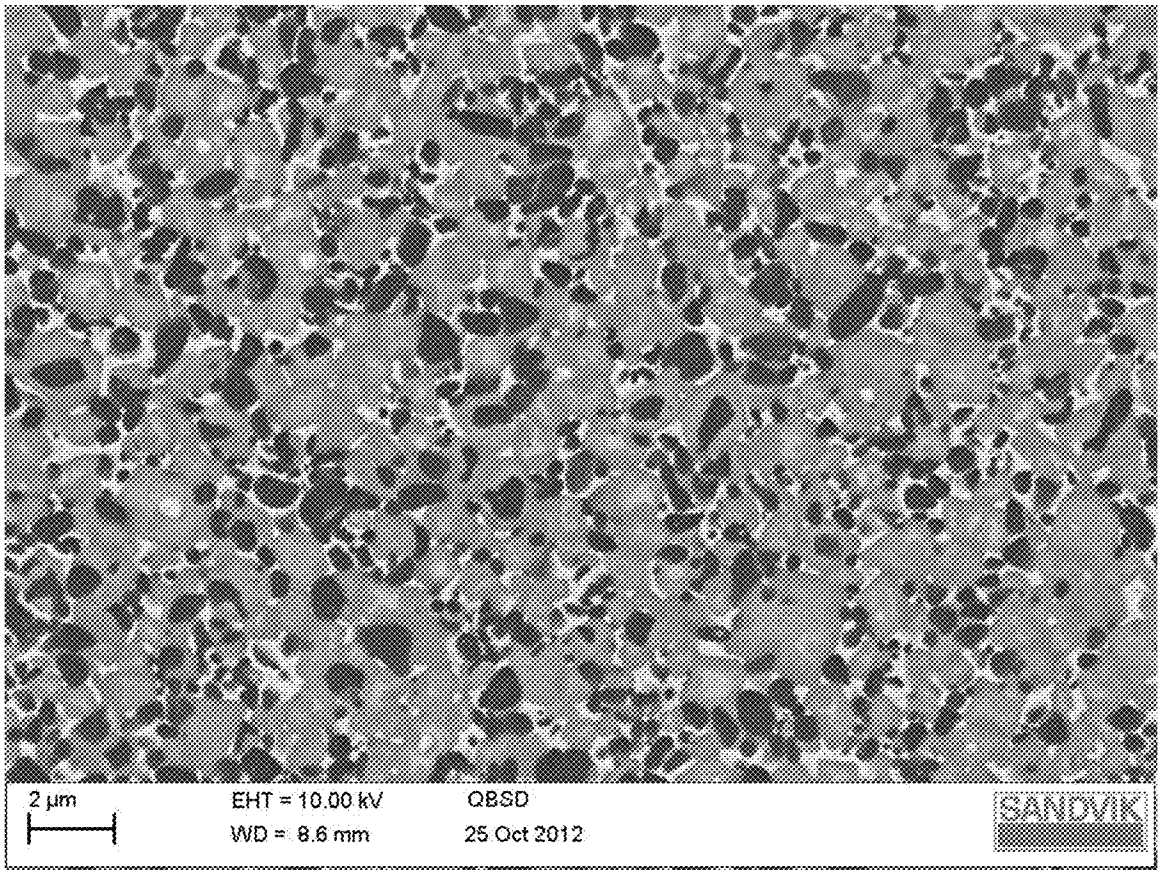
FIG. 3 is a SEM image of a second necking tool material according to the present disclosure.

Two cemented carbide bodies according to the present disclosure were prepared and characterized (Samples A and B) as shown in Table 1. The samples were analyzed by electron microscopy. The SEM micrograph of Sample A is shown in FIG. 2 and Sample B is shown in FIG. 3. As shown, it can be seen that the morphology and distribution of the hard and matrix phases are uniform.

Both Sample A and B have a grain size from about 0.5 μm to about 1 μm. The binder content for both samples is approximately 14%. Preferably, about 6 to about 18% Co/Ni.

According to one aspect, the necking tool is made of a cemented carbide including in wt % of about 18 to less than 63 WC; of about 20 to less than 30 TiC; of about 0 to less than 27 TiN; of about 0 to less than 12 NbC; of about 0 to about 2 $Cr_3C_2$; of about 8 to about 14 Co; and of about 0 to less than 6 Ni.

According to another aspect, the necking tool is made of cemented carbide including in wt % about less than 63 WC, and more preferably about 62.8 WC; about 21 TiC; about 2 Cr3C2; about 8 Co and more preferably 8.3 Co; and less than about 6 Ni and more preferably about 5.7 Ni. Accordingly, the binder phase consists of Co and Ni and has a content of approximately 14 wt %.

In another aspect, the necking tool is made of a cemented carbide including in wt-%, of about 18 WC, and more preferably, about 18.08 WC; less than about 30 TiC, and more preferably about 29.66 TiC; less than about 27 TiN, and more preferably 26.46 TiN; less than about 12 NbC, and more preferably about 11.63; and about 14 Co and more preferably about 14.17 Co.

Figure 4:
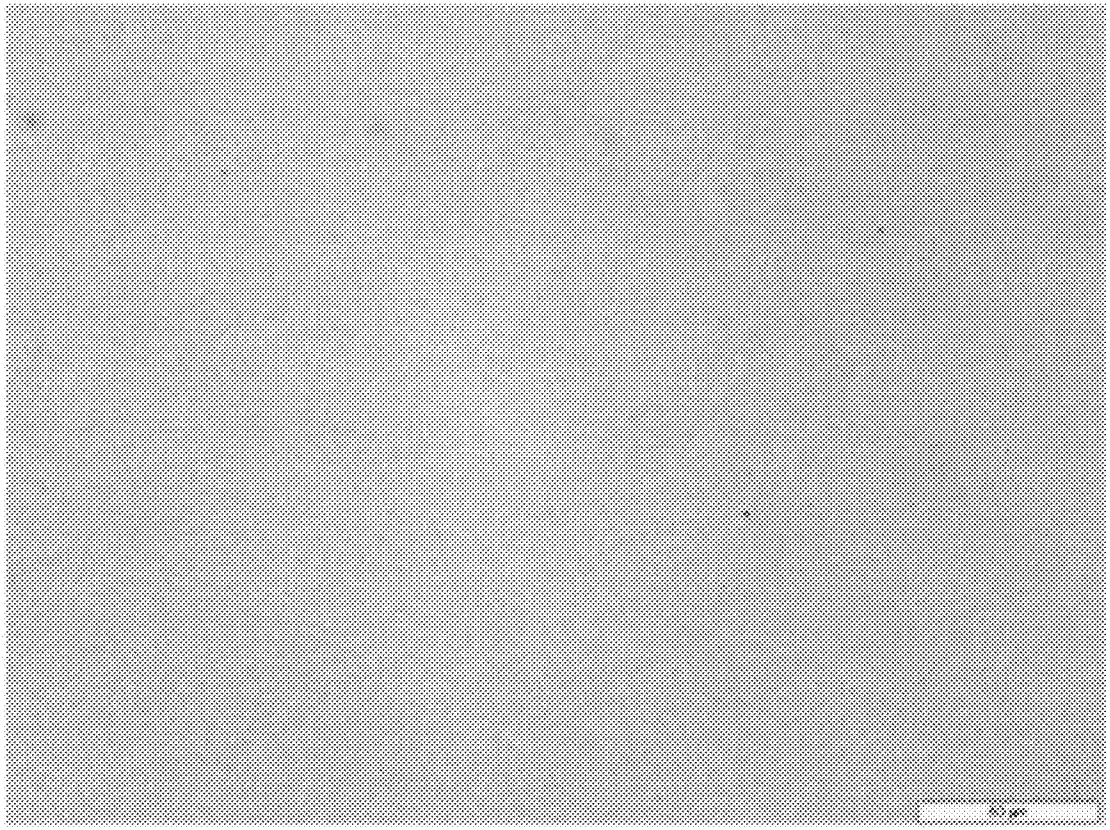
FIG. 4 is a SEM image of the porosity level of Sample B of FIG. 3.

Referring to Table 1 and as can be seen in FIG. 3, Sample B utilizes N to inhibit grain growth. Moreover, the Ti grains are spherical and the Co binder well distributed. Also, as shown in FIG. 4, the optical micrograph shows A02/A04 type porosity levels.

Other properties were measured according to standards used in the cemented carbide industry as shown in Table 2 below.

TABLE 2

| | Density ($g/cm^3$) | Hardness ($kg/mm^2$) | Young's Modulus (GPa) | Coefficient of thermal expansion 20-200° C. ($1 \times 10^{-6}$/° C.) |
|---|---|---|---|---|
| Sample A | 9.86 | 1450 | 440 | 7.13 |
| Sample B | 6.62 | 1650 | 400 | 7.49 |
| Comparative | 14.25 | 1335 | 590 | 5.41 |

As can be seen, Samples A and B have a much higher hardness, about 1450 and 1650 respectively and a much lower density, of less than about 10 $g/cm^3$, than the comparative H12N, about 9.86 and about 6.62 respectively, and closer thermal expansion, about 7.13 and about 7.49, to known tool steel.

Although the present disclosure has been described in relation to particular embodiments thereof, many other variations and modifications and other uses will become apparent to those skilled in the art. It is preferred therefore, that the present disclosure be limited not by the specific disclosure herein, but only by the appended claims.

What is claimed is:

1. A necking tool for manufacturing of metal beverage cans, the necking tool being a cemented carbide comprising in wt % about 18 WC, about 30 TiC, about 27 TiN, about 12 NbC, from 1 $Cr_3C_2$ to 2 $Cr_3C_2$ and about 14 Co.

2. The necking tool of claim 1, wherein the cemented carbide comprises in wt % 18.08 WC.

3. The necking tool of claim 1, wherein the cemented carbide comprises in wt % 29.66 TiC.

4. The necking tool of claim 1, wherein the cemented carbide comprises in wt % 26.46 TiN.

5. The necking tool of claim 1, wherein the cemented carbide comprises in wt % 11.63 NbC.

6. The necking tool of claim 1, wherein the cemented carbide comprises in wt % 14.17 Co.

7. The necking tool of claim 1, wherein the cemented carbide has a grade with a grain size less than about 1 μm.

8. The necking tool of claim 7, wherein the grain size is about 0.5 to 1 μm.

9. The necking tool of claim 7, wherein the grain size is about 0.5 to 0.9 μm.

10. The necking tool of claim 1, wherein the cemented carbide has a density of about 6.62 $g/cm^3$.

11. The necking tool of claim 1, wherein the cemented carbide has a hardness of about 1650 $kg/mm^2$.

12. The necking tool of claim 1, wherein the cemented carbide has a coefficient of thermal expansion of about 7.49 $1 \times 10^{-6}$/° C.

13. A necking tool for manufacturing of metal beverage cans, the necking tool being a cemented carbide comprising in wt % about 18 WC, less than about 30 TiC, less than about 27 TiN, less than about 12 NbC, 2 $Cr_3C_2$, and about 14 Co.

14. The necking tool of claim 13, further comprising in wt % 0 of AlN.

15. The necking tool of claim 1, further comprising in wt % 0 of AlN.

16. A necking tool for manufacturing of metal beverage cans, the necking tool being a cemented carbide comprising in wt % about 18 WC, less than about 30 TiC, less than about 27 TiN, less than about 12 NbC, about 14 Co, 1 of $Cr_3C_2$ and 0 of AlN.

* * * * *